United States Patent [19]

Rogers

[11] 4,276,715

[45] Jul. 7, 1981

[54] PUPPET

[76] Inventor: Robert D. Rogers, 11 Cornell Pl., New Rochelle, N.Y. 10804

[21] Appl. No.: 124,490

[22] Filed: Feb. 25, 1980

[51] Int. Cl.[3] ..... A63H 3/14; A63H 3/38; A63H 3/36

[52] U.S. Cl. ..... 46/154; 46/165; 46/171

[58] Field of Search ..... 46/154, 164, 165, 22, 46/1 R, 135 R, 119, 156, 126, 171, 167, 115; D21/151-153

[56] References Cited

U.S. PATENT DOCUMENTS

| | | | |
|---|---|---|---|
| 1,028,068 | 5/1912 | Hamley | 46/154 |
| 1,354,382 | 9/1920 | Denvelle | 46/165 |
| 1,437,406 | 12/1922 | Druzbach | 46/151 |
| 2,546,209 | 3/1951 | Baum | 46/154 |
| 2,751,708 | 6/1956 | Plummer | 46/171 |
| 3,425,626 | 2/1969 | Dietz et al. | 46/115 |
| 4,054,006 | 10/1977 | Estlund | 46/154 |

*Primary Examiner*—Gene Mancene
*Assistant Examiner*—Michael J. Foycik
*Attorney, Agent, or Firm*—Wolder, Gross & Yavner

[57] ABSTRACT

A puppet structure includes a support pole to which is attached a pair of protruding eye parts at the top end thereof. A cooperating operator's glove encircles the support pole and terminates in a mouth part, which serves both to add to the play value of the item and to retain the operator's glove to the pole. Finger manipulation of the operator provides various appearance configurations for the mouth part and rotation of the support pole animates the eye parts.

3 Claims, 3 Drawing Figures

PUPPET

This invention relates primarily to puppet structures and more particularly to puppet structures which include separately movable parts to present a plurality of widely varying appearance configurations.

Of course, the puppet industry is one that has bridged the centuries in terms of entertaining youngsters all over the world. Perhaps as far back as prehistoric times, children have been entertained by many types of puppet structures. From the beginning of this art to most notably the 19th century, such puppet structures were of crude appearance and formed of only the most basic materials. Nineteenth century puppet structures became much more elaborate and the puppet artisans attempted to duplicate human configuration with their products. More recently, the puppet industry has changed to produce the outlandish configurations for puppets which one observes in the marketplace today. In other words, today's young people seem more entertained by the fantasy and play value offered by puppets that resemble anything but humans and whose motion and varied configurations are the products only of the wildest imaginations. It is also of particular entertainment value for the puppet structure to be operable simply enough so that the child himself is able to competently manipulate and otherwise operate the puppet.

Accordingly, a primary object of the present invention is to provide a puppet structure with entertainment and play value.

A further object of the present invention is to provide a puppet of simple structure, and yet which may be articulated to enhance the entertainment and play value.

A further and more specific object of the present invention is to provide a puppet structure which assumes a plurality of configurations and yet is easy to operate and build by the child himself.

These and other objects of the present invention are provided by a puppet structure which features a support pole, attached to the top end of which are a pair of eye parts extending in opposite directions perpendicular to the support pole. An operator's glove is intended to encircle the support pole so that the pole extends through the middle fingers thereof. The fingers of the operator's glove teminate in a generally circular mouth part of flexible material which cooperates with the eye parts in presenting a facial configuration for the puppet. The support pole is upwardly and downwardly movable with respect to the glove and rotatable; and the mouth part, as stated, is flexible, all to provide varying facial configurations for the puppet.

Figure 1:
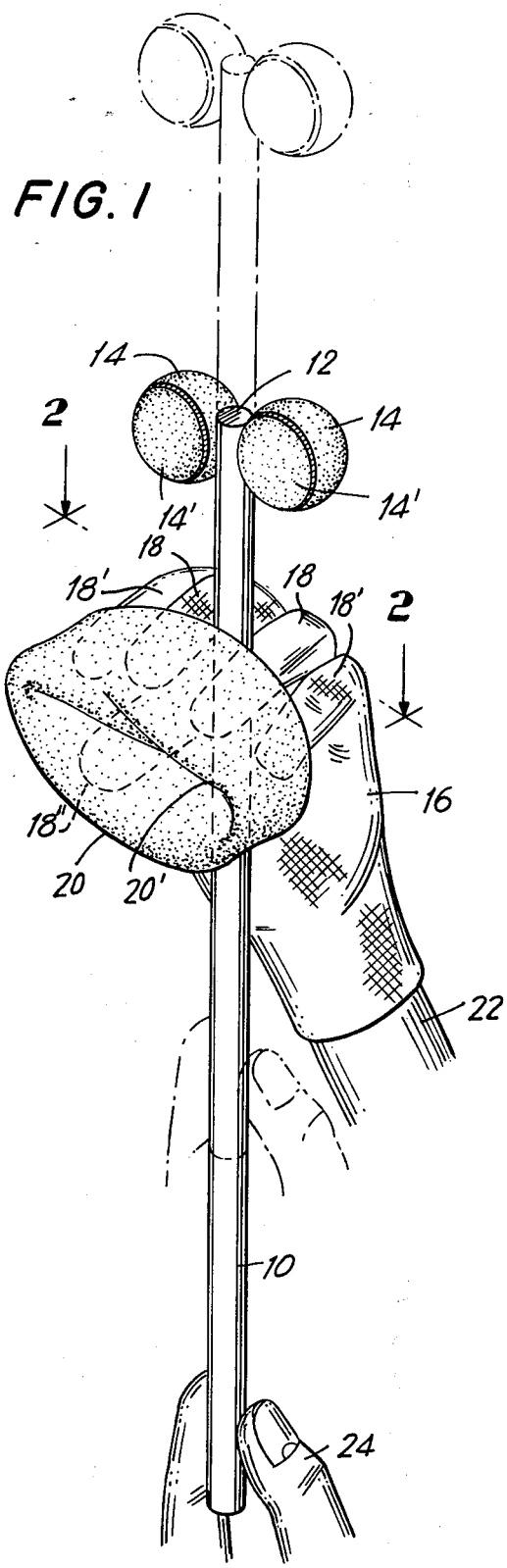
Figure 2:
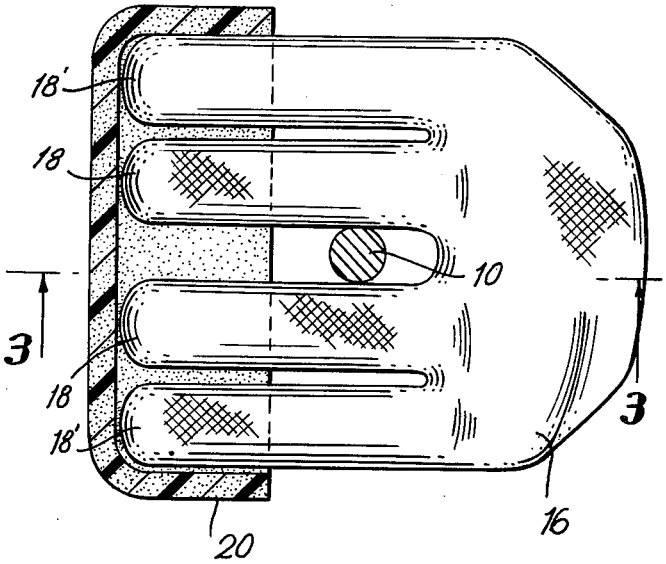
Figure 3:
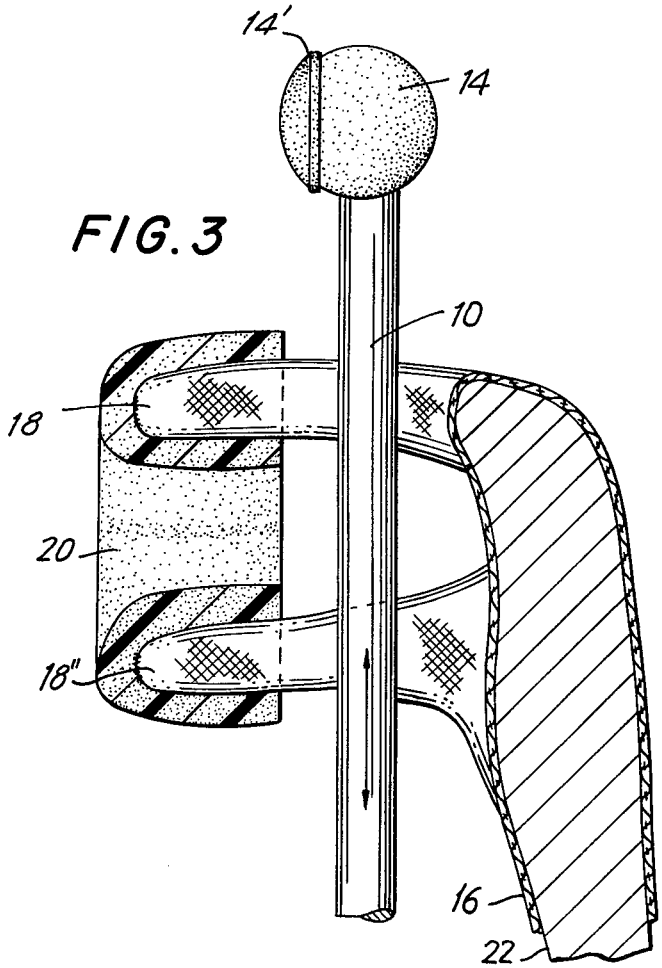

Other objects, features and advantages of the present invention will be provided by reference to the following detailed description of a preferred, but nonetheless illustrative, embodiment with reference to the accompanying drawings, wherein:

FIG. 1 is an isometric representation of the puppet structure of the present invention with an indication of its operation;

FIG. 2 is a top sectional view of the glove and mouth part portion of the present invention, taken along the line 2—2 of FIG. 1 and showing particularly the placement of the support pole and the attachment of the mouth part to the glove; and FIG. 3 is a side sectional view taken along the line 3—3 of FIG. 2 and showing particularly the cooperation operation of the support pole and glove with attached eye parts and mouth part, respectively.

Referring to the drawings, a puppet structure is shown to include a support pole 10 terminating at or near its upper end 12 with a pair of eye parts 14 extending in opposite directions perpendicular to the axis of support pole 10.

Glove 16 encircles pole 10 so that pole 10 movably extends between middle fingers 18 of the glove. Middle fingers 18, end fingers 18' and thumb 18'' of glove 16 terminate in mouth part 20, which is a generally circular, flexible piece providing the mouth for the puppet.

Furthermore, color and/or expression is further provided to the puppet by the addition of eyes 14' to eye parts 14.

In order to provide a more complete description of the present invention a series of building and operational steps are now provided. The puppet of the present invention is formed from even the most basic materials. For instance, foam material is used to provide mouth part 20. The glove of the present invention is a standard and readily available glove, either left-handed or right-handed, depending upon the needs of the operator. The eyes are formed of ping pong balls, or the like, with paint or felt material used for the eyes 14'. Additionally, fur may be used for eye brows (not shown) and hanger cardboard for support pole 10. Attachments are made by the use of thread or glue, or the like. Additionally, a small piece of white material may be attached to opening 20' of mouth part 20 in order to simulate a tooth (not shown).

Assembly is accomplished by inserting one of the operator's hands 22 into glove 16 with support pole 10 movably extending between middle fingers 18 of glove 16. Mouth part 20 is either removably attached to fingers 18 and 18' and thumb 18'' after insertion of support pole 10 between middle fingers 18 or fixedly or removably attached prior to such insertion, with pole 10 so inserted after assembly of the glove with mouth part 20. Before insertion of pole 10 between middle fingers 18, eye parts 14 are attached as shown.

In operation, the hand 24 of the operator, not used for insertion to glove 16, is used to both rotate and lift and lower support pole 10. Accordingly, the pole 10 may be lifted to the position shown by ghost lines in FIG. 1 to provide a large separation between eye parts 14 and mouth part 20 in one facial configuration of the puppet, and the pole lowered to the position shown by solid lines in FIG. 1 to give another configuration of the puppet. Of course, any position therebetween may be assumed to provide other facial configurations. Furthermore, still other configurations are provided by rotating pole 10 by means of hand 24. Still further, combinations of such configurations are enhanced by distortion of mouth part 20 in order to provide various expressional appearances for the puppet.

It is within the purview of the present invention to further enhance the entertainment and play value of the puppet structure by various other modifications, all considered to be within the scope of the present invention if within the limitations thereof provided only by the following claims:

What is claimed is:

1. A puppet structure for providing a plurality of facial configurations comprising, in combination, an elongated support pole, an eye part fixedly and rigidly attached at one end of said pole, a glove having five fingers including at least a pair of fingers straddling said support pole for up and down and rotative motion thereof and a flexible mouth part mounted at the ends of said five fingers and for retaining said support pole.

2. The invention according to claim 1, wherein said eye part includes a pair of eyes extending in opposite directions, generally perpendicular to the axis of said support pole.

3. The invention according to claim 1, wherein said support pole is rotatable with respect to said glove.

* * * * *